US010041139B2

(12) United States Patent
Chung et al.

(10) Patent No.: US 10,041,139 B2
(45) Date of Patent: Aug. 7, 2018

(54) HIGH-STRENGTH STEEL SHEET AND MANUFACTURING METHOD THEREFOR

(71) Applicant: Hyundai Steel Company, Dong-gu, Incheon (KR)

(72) Inventors: Jun Ho Chung, Seoul (KR); Seong-Ju Kim, Yongin-Si (KR); Hyo Dong Shin, Daegu (KR)

(73) Assignee: HYUNDAI STEEL COMPANY, Incheon (KR)

( * ) Notice: Subject to any disclaimer, the term of this patent is extended or adjusted under 35 U.S.C. 154(b) by 217 days.

(21) Appl. No.: 14/392,119

(22) PCT Filed: Jun. 27, 2014

(86) PCT No.: PCT/KR2014/005756
§ 371 (c)(1),
(2) Date: Dec. 23, 2015

(87) PCT Pub. No.: WO2014/209064
PCT Pub. Date: Dec. 31, 2014

(65) Prior Publication Data

US 2016/0145706 A1 May 26, 2016

(30) Foreign Application Priority Data

Jun. 27, 2013 (KR) ..... 10-2013-0074925
Jun. 27, 2013 (KR) ..... 10-2013-0074926

(51) Int. Cl.

| | |
|---|---|
| ***C21D 9/46*** | (2006.01) |
| ***C22C 38/26*** | (2006.01) |
| ***C22C 38/24*** | (2006.01) |
| ***C21D 8/02*** | (2006.01) |
| ***C22C 38/38*** | (2006.01) |
| ***C22C 38/58*** | (2006.01) |
| ***C22C 38/04*** | (2006.01) |
| ***C22C 38/06*** | (2006.01) |
| ***C22C 38/12*** | (2006.01) |
| ***C21D 6/00*** | (2006.01) |
| ***C21D 1/26*** | (2006.01) |
| ***C22C 38/00*** | (2006.01) |
| ***C22C 38/22*** | (2006.01) |

(52) U.S. Cl.

CPC ..... *C21D 9/46* (2013.01); *C21D 1/26* (2013.01); *C21D 6/002* (2013.01); *C21D 6/005* (2013.01); *C21D 8/02* (2013.01); *C21D 8/0205* (2013.01); *C21D 8/0226* (2013.01); *C21D 8/0236* (2013.01); *C21D 8/0247* (2013.01); *C21D 8/0263* (2013.01); *C22C 38/001* (2013.01); *C22C 38/04* (2013.01); *C22C 38/06* (2013.01); *C22C 38/12* (2013.01); *C22C 38/22* (2013.01); *C22C 38/24* (2013.01); *C22C 38/26* (2013.01); *C22C 38/38* (2013.01); *C22C 38/58* (2013.01); *C21D 2211/001* (2013.01); *C21D 2211/004* (2013.01)

(58) Field of Classification Search

CPC ..... C21D 1/26; C21D 2211/001; C21D 2211/004; C21D 6/002; C21D 6/005; C21D 8/02; C21D 8/0205; C21D 8/0226; C21D 8/0236; C21D 8/0247; C21D 8/0263; C21D 9/46; C22C 38/001; C22C 38/04; C22C 38/06; C22C 38/12; C22C 38/22; C22C 38/24; C22C 38/26; C22C 38/38; C22C 38/58

See application file for complete search history.

(56) References Cited

U.S. PATENT DOCUMENTS

2013/0295409 A1* 11/2013 Chin ..... C21D 8/02 428/653

FOREIGN PATENT DOCUMENTS

| | | | | |
|---|---|---|---|---|
| CN | 106399858 | A | * | 2/2017 |
| JP | 2006118000 | A | | 5/2006 |
| JP | 2006176843 | A | | 7/2006 |
| JP | 2009287114 | A | | 12/2009 |
| KR | 20060071618 | A | | 6/2006 |
| KR | 20120065464 | A | | 6/2012 |

OTHER PUBLICATIONS https://web.archive.org/web/20120901052844/https://en.wikipedia.org/wiki/Titanium_aluminide (Year: 2012).*

PCT International Search Report and English translation thereof, issued on corresponding PCT International Application No. PCT/KR2014/005756, 5 pages.

* cited by examiner

*Primary Examiner* — Jenny R Wu

(74) *Attorney, Agent, or Firm* — Bryan D. Zerhusen; Locke Lord LLP

(57) ABSTRACT

A high-strength steel sheet according to the present invention comprises, by weight, 10.0-15.0% Mn, 6.0-9.0% Al, 0.5-2.0% Cr, 0.8-1.6% C, and 0.001-0.01% N, and further comprises, by weight, 0.02-0.1% V, 0.005-0.015% Nb, and 0.005-0.02% Mo, or further comprises 0.1-0.5 wt % TiAl particles. The high-strength steel sheet has a mixed structure comprising austenite and a fine k-carbide having a mean particle diameter of 10-500 nm.

4 Claims, No Drawings

HIGH-STRENGTH STEEL SHEET AND MANUFACTURING METHOD THEREFOR

This application is a United States National Stage application of PCT International Application No. PCT/KR2014/005756 filed Jun. 27, 2014, which claims priority to Korean Patent application No. KR 10-2013-0074925 filed Jun. 27, 2013, and Korean Patent Application No. KR 10-2013-0074926 filed Jun. 27, 2013, each of which are incorporated herein in their entirety.

TECHNICAL FIELD

The present invention relates to steel sheet production technology, and more particularly, to a high-strength steel sheet having high strength, high ductility and low density and to a method for producing the same.

BACKGROUND ART

Currently, environmental disasters caused by global warming and the resulting weather changes are becoming more severe every day. One of the major causes of global warming is the emission of carbon dioxide by the use of fossil fuels and the resulting air pollution. One of the major causes of carbon dioxide emissions is exhaust gas from vehicles. For this reason, in advanced countries including Europe and the USA, vehicle fuel economy regulations have been provided, and fuel economy regulations are also being more stringent every day. The best way to increase vehicle fuel economy is to reduce the weight of vehicles. For this purpose, in the steel field, many studies have been conducted to improve high strength and high ductility properties. In addition, in recent years, the need for high strength and high ductility lightweight steel sheets having low density together with high strength and high ductility properties has increased.

Prior art documents related to the present invention include Korean Laid-Open Patent Publication No. 10-2006-0071618 (published on Jun. 27, 2006), entitled "High-manganese steel having excellent abrasion resistance and impact resistance and method for producing the same".

DISCLOSURE

Technical Problem

It is an object of the present invention to provide a high-strength steel sheet which has high strength and high ductility and, at the same time, can contribute to a reduction in weight, and a method for producing the same.

Technical Solution

To achieve the above object, in accordance with a first embodiment of the present invention, there is provided a high-strength steel sheet comprising, by weight, 10.0-15.0% manganese (Mn), 6.0-9.0% aluminum (Al), 0.5-2.0% chromium (Cr), 0.8-1.6% carbon (C), 0.001-0.01% nitrogen (N), 0.02-0.1% vanadium (V), 0.005-0.015% niobium (Nb), and 0.005-0.02% molybdenum (Mo), with the remainder being iron (Fe) and inevitable impurities, the steel sheet having a mixed structure comprising austenite and a fine k-carbide ($(Fe,Mn)_3AlC$) having a mean grain size of 10-500 nm.

Herein, the high-strength steel sheet may have a density of 7.1 g/cm$^3$ or lower.

The high-strength steel sheet may be a cold-rolled steel sheet, and may show a tensile strength of 1000 MPa or higher and an elongation of 20% or higher.

In accordance with a second embodiment of the present invention, there is provided a high-strength steel sheet comprising, by weight, 10.0-15.0% manganese (Mn), 6.0-9.0% aluminum (Al), 0.5-2.0% chromium (Cr), 0.8-1.6% carbon (C), 0.001-0.01% nitrogen (N), and 0.1-0.5% TiAl particles, with the remainder being iron (Fe) and inevitable impurities, the steel sheet having a mixed structure comprising austenite and a fine k-carbide ($(Fe,Mn)_3AlC$) having a mean grain size of 10-500 nm.

Herein, the high-strength steel sheet may have a density of 7.1 g/cm$^3$ or lower.

The high-strength steel sheet may be a hot-rolled steel sheet, and may show a tensile strength of 1200 MPa or higher and a product of tensile strength and elongation (TS×EL) of 35,000 MPa·% or higher.

A method for producing the high-strength steel sheet in accordance with the first embodiment of the present invention comprises: hot-rolling a steel slab comprising, by weight, 10.0-15.0% manganese (Mn), 6.0-9.0% aluminum (Al), 0.5-2.0% chromium (Cr), 0.8-1.6% carbon (C), 0.001-0.01% nitrogen (N), 0.02-0.1% vanadium (V), 0.005-0.015% niobium (Nb), and 0.005-0.02% molybdenum (Mo), with the remainder being iron (Fe) and inevitable impurities, at a finish-rolling temperature equal to or higher than the Ar3 point to obtain hot-rolled steel sheet, and coiling the hot-rolled steel sheet at a temperature between 300° C. and 700° C.

Herein, the method may comprise cold-rolling the hot-rolled steel sheet, and annealing the cold-rolled steel sheet at an austenite single-phase region temperature equal to or higher than the Ac3 point for 200-300 seconds.

A method for producing the high-strength steel sheet in accordance with the second embodiment of the present invention comprises: hot-rolling a steel slab comprising, by weight, 10.0-15.0% manganese (Mn), 6.0-9.0% aluminum (Al), 0.5-2.0% chromium (Cr), 0.8-1.6% carbon (C), 0.001-0.01% nitrogen (N), and 0.1-0.5% TiAl particles, with the remainder being iron (Fe) and inevitable impurities, at a finish-rolling temperature equal to or higher than the Ar3 point to obtain hot-rolled steel sheet, and coiling the hot-rolled steel sheet at a temperature between 300° C. and 700° C.

Advantageous Effects

The high-strength steel sheet according to the present invention has a significantly low manganese content compared to general high-manganese steel sheets having a manganese (Mn) content of 20 wt % or higher. Thus, it can be produced at reduced costs, can solve the problem of reduced productivity of steel-making processes, and can also be easily machined.

In addition, the high-strength steel sheet according to the present invention comprises 0.5-2.0 wt % of chromium (Cr) and a suitable amount of vanadium, molybdenum, vanadium, or TiAl particles. Thus, the austenite stability of the steel sheet can be increased, and k-carbide coarsening in the steel sheet can be suppressed. Therefore, the high-strength steel sheet according to the present invention may have a mixed structure comprising austenite and nano-scale fine k-carbide.

Additionally, the high-strength steel sheet according to the present invention has an aluminum content of 6.0-9.0 wt %, and thus can greatly contribute to low weight. Also, it can show a tensile strength of 1000 MPa or higher and an elongation of 20% or higher.

MODE FOR INVENTION

Hereinafter, a steel sheet according to an embodiment of the present invention and a production method thereof will be described in detail.

High-Strength Steel Sheet

The high-strength steel sheet according to the present invention comprises, by weight, 10.0-15.0% manganese (Mn), 6.0-9.0% aluminum (Al), 0.5-2.0% chromium (Cr), 0.8-1.6% carbon (C), and 0.001-0.01% nitrogen (N).

In addition, the high-strength steel sheet according to the present invention further comprises one or more of the following (i) and (ii):

(i) by weight, 0.02-0.1% vanadium (V), 0.005-0.015% niobium (Nb), and 0.005-0.02% molybdenum (Mo); and (ii) by weight, 0.1-0.5% TiAl particles.

The high-strength steel sheet comprises, in addition to the above-described components, inevitable impurities such as iron (Fe), phosphorus (P) and sulfur (S), which are incorporated during steel-making processes.

The functions and contents of components contained in the high-strength steel sheet of the present invention will now be described.

Manganese (Mn)

Manganese (Mn) contributes to austenite stabilization. In addition, manganese is an element that increases stacking fault energy. Particularly, manganese functions to increase the lattice constant to reduce the density to thereby lower the weight of the steel sheet.

Manganese is preferably contained in an amount of 10.0-15.0 wt %, more preferably 11.0-13.0 wt %, based on the total weight of the steel sheet. If the content of manganese in the steel sheet is less than 10.0 wt %, the effect of addition thereof will be insufficient, and particularly, the austenite phase can be unstable at a temperature lower than 800° C. On the contrary, if the content of manganese in the steel sheet is more than 15.0 wt %, it can result in a reduction in the productivity of steel-making process and a decrease in the machinability of the steel sheet together with an increase in the production cost.

Aluminum (Al)

Aluminum is a low-density element and contributes to a reduction in the weight of the steel by lowering the specific density of the steel.

Aluminum is preferably contained in the steel sheet in an amount of 6.0-9.0 wt % based on the total weight of the steel sheet, and is more preferably contained in an amount of 6.0-7.5 wt % in view of continuous casting. If the content of aluminum in the steel sheet is less than 6.0 wt %, it will be difficult to maintain the density of the steel sheet at 7.1 g/cm$^3$ or lower. On the contrary, if the content of aluminum in the steel sheet is more than 9.0 wt %, coarse k-carbide can be formed to reduce the elongation of the steel sheet.

Chromium (Cr)

Chromium (Cr) functions to stabilize k-carbide to thereby suppress k-carbide coarsening and suppress proeutectoid ferrite formation.

Chromium is preferably contained in an amount of 0.5-2.0 wt %, and more preferably 1.0-2.0 wt %, based on the total weight of the steel sheet. If the content of chromium in the steel sheet is less than 0.5 wt %, the effect of suppressing k-carbide coarsening will be insufficient. On the contrary, if the content of chromium in the steel sheet is more than 2.0 wt %, it can form Cr-based carbides that can reduce the mechanical properties of the steel sheet.

Carbon (C)

Carbon (C) is added in order to stabilize austenite and increase strength.

Carbon is preferably contained in an amount of 0.8-1.6 wt % based on the total weight of the steel sheet, and is more preferably contained in an amount of 1.0-1.2 wt % in terms of prevention of k-carbide coarsening. If the content of carbon in the steel sheet is less than 0.8 wt %, the effect of addition thereof will be insufficient. On the contrary, if the content of carbon in the steel sheet is more than 1.6 wt %, coarse k-carbide can precipitate to reduce the elongation of the steel sheet.

Nitrogen (N)

Nitrogen (N) contributes to austenite stabilization and forms carbonitrides that contribute to an increase in the strength of the steel sheet.

Nitrogen is preferably contained in an amount of 0.001-0.01 wt % based on the total weight of the steel sheet. If the content of nitrogen in the steel sheet is less than 0.001 wt %, it will be difficult to exhibit the above-described effects. On the contrary, if the content of nitrogen in the steel sheet is more than 0.01 wt %, it can form coarse AlN that can cause problems such as nozzle clogging.

Vanadium (V), Niobium (Nb) and Molybdenum (Mo)

Vanadium (V) forms vanadium carbonitrides that contribute to an increase in the strength of the steel sheet. Vanadium is preferably added in an amount of 0.02-0.1 wt % based on the total weight of the steel sheet. If the amount of vanadium added is less than 0.02 wt %, the effect of addition thereof will be insufficient. On the contrary, if the amount of vanadium added is more than 0.1 wt %, it will cause slab cracks and reduce the rolling property of the steel.

Niobium (Nb) also forms precipitates together with vanadium to thereby greatly contribute an increase in the strength of the steel sheet. Niobium is preferably added in an amount of 0.005-0.015 wt % based on the total weight of the steel sheet. If the amount of niobium added is less than 0.005 wt %, the effect of addition thereof will be insufficient. On the contrary, if the amount of niobium added is more than 0.2 wt %, it can reduce the continuous casting property of the steel sheet and can excessively increase the yield ratio of the steel sheet.

Molybdenum (Mo) is an element that contributes to austenite stabilization and is effective in increasing the strength and toughness of the steel sheet. Molybdenum is preferably added in an amount of 0.005-0.02 wt % based on the total weight of the steel sheet. If the amount of molybdenum added is less than 0.005 wt %, the effect of addition thereof will be insufficient. On the contrary, if the amount of molybdenum added is more than 0.02 wt %, it will reduce the ductility of the steel sheet produced.

Meanwhile, in view of continuous casting properties and rolling properties, the sum of the amounts of niobium (Nb), vanadium (V) and molybdenum (Mo) added is preferably 0.12 wt % or less based on the total weight of the steel sheet.

TiAl Particles

TiAl particles contribute to dispersion strengthening of the steel sheet of the present invention. The TiAl particles that are used in the present invention may have a mean particle size of about 10-100 nm. Addition of the TiAl particles can improve the high-temperature creep resistance and chemical stability of the steel sheet to thereby increase the melting point of the steel sheet. TiAl has the property of exhibiting low density (4.0 g/cm$^3$) and high heat resistance.

The TiAl particles are preferably contained in an amount of 0.1-0.5 wt % based on the total weight of the steel sheet, and are more preferably contained in an amount of 0.2-0.3 wt % in terms of prevention of TiAl coarsening. If the content of TiAl particles in the steel sheet is less than 0.1 wt %, the effect of addition thereof will be insufficient. On the contrary, the content of TiAl particles in the steel sheet is more than 0.5 wt %, the brittleness of the steel sheet can increase.

The high-strength steel sheet of the present invention, which comprise the above-described components, may have a mixed structure comprising austenite and a fine k-carbide ($(Fe,Mn)_3AlC$) having a mean grain size of 10-500 nm, through process control as described below. The mixed structure may comprise about 0.5-5% by area of ferrite.

Furthermore, because the high-strength steel sheet according to the present invention has a mixed structure comprising austenite and fine k-carbide ($(Fe,Mn)_3AlC$), it can show a density of 7.1 g/cm$^3$ or lower, a tensile strength of 1000 MPa or higher, an elongation of 20% or higher, and a yield ratio of about 0.87-0.92. In addition, if the steel sheet of the present invention is subjected to cold rolling and annealing heat treatment, it can show a hole expandability of about 30-40%.

Accordingly, the high-strength steel sheet according to the present invention can maintain high rigidity, and thus can be used as materials for various structural parts such as automotive pillars.

Method for Producing High-Strength Steel Sheet

A method for producing the high-strength steel sheet according to the present invention is a method for producing a hot-rolled steel sheet, and may comprise hot-rolling a steel slab comprising the above-described components at a finish-rolling temperature equal to or higher than the Ar3 point to obtain a hot-rolled steel sheet, and cooling the hot-rolled steel sheet at a cooling rate of 5-50° C./sec, followed by coiling at a temperature between 300° C. and 700° C.

If the finish-rolling temperature in the hot-rolling of the steel slab is lower than the Ar3 point, the physical properties of the steel sheet can be reduced. In addition, if the coiling temperature is higher than 700° C., it will be difficult to ensure sufficient strength, and if the coiling temperature is lower than 300° C., the ductility of the steel sheet can be reduced.

Before hot-rolling, a process of reheating the steel slab having the above-described alloy composition at a temperature between 1150° C. and 1250° C. for 1-4 hours may further be performed.

In addition, the method for producing the high-strength steel sheet according to the present invention is a method for producing a cold-rolled steel sheet, and may comprise cold-rolling the hot-rolled steel sheet, produced as described above, at a reduction ratio of about 40-80%, annealing the cold-rolled steel sheet at an austenite single-phase region temperature equal to or higher than the Ac3 point for 100-300 seconds. If the annealing time is shorter than 100 seconds, austenite formation can be insufficient. On the contrary, the contrary, the annealing time is longer than 300 seconds, austenite and fine k-carbide will be coarsened, resulting in decreases in the strength and elongation of the steel sheet.

EXAMPLES

Steel ingot specimens having the alloy compositions shown in Table 1 below were prepared.

TABLE 1

(unit: wt %)

| Specimen | Mn | Al | Cr | C | V | Nb | Mo | N | Remarks |
|---|---|---|---|---|---|---|---|---|---|
| 1 | 13.55 | 8.22 | 0.003 | 1.16 | 0.03 | 0.01 | 0.01 | 0.005 | Comparative Example |
| 2 | 12.00 | 7.00 | 1.90 | 1.05 | 0.05 | 0.008 | 0.01 | 0.008 | Example |
| 3 | 12.05 | 6.95 | 1.85 | 1.20 | 0.04 | 0.01 | 0.015 | 0.006 | Example |
| 4 | 13.06 | 8.04 | 2.20 | 1.50 | 0.03 | 0.01 | 0.01 | 0.005 | Comparative Example |
| 5 | 13.19 | 7.88 | 4.60 | 1.19 | 0.04 | 0.005 | 0.005 | 0.005 | Comparative Example |
| 6 | 12.95 | 6.27 | 4.50 | 1.13 | 0.03 | 0.01 | 0.01 | 0.005 | Comparative Example |

Each of steel ingot specimens 1 to 6 was reheated at 1200° C. for 2 hours, hot-rolled at a finish-rolling temperature of 880° C., cooled to 600° C. at a rate of 20° C./sec, and then cooled in air to room temperature. Next, each hot-rolled specimen was cold-rolled at a reduction ratio of 50%, annealed at 860° C. for 250 seconds, cooled to 400° C. at a cooling rate of 10° C./sec, and then cooled in air to room temperature.

The density and mechanical properties of each of prepared specimens 1 to 6 were measured in the following manner, and the results of the measurement are shown in Table 2 below.

For density measurement, the central portion of each of the specimens was sampled, and the density of the sample was measured using the Archimedes principle. As a standard sample, a 99.8% pure indium (In) ingot (7.31 g/cm$^3$) was used.

For tensile strength (TS) and elongation (EL) testing, tensile strength specimens were machined to ASTM E8 standards. Tensile strength testing was performed at a cross-head speed of 0.5 mm/min at room temperature. This speed corresponds to an initial strain rate of $3.3\times10^{-4}s^{-1}$.

TABLE 2

| Specimen | Density (g/cm$^3$) | Hot-rolled material (TS and EL) | Cold-rolled material (TS, EL and Hole Expansion Ratio(HER)) | Remarks |
|---|---|---|---|---|
| 1 | 6.93 | 1,315 MPa and 13% | Breakage | Comparative Example |
| 2 | 7.02 | 1,058 MPa and 30% | 1,077 MPa, 24% and 36% | Example |
| 3 | 6.97 | 1,294 MPa and 29% | 1,186 MPa, 32% and 34% | Example |

TABLE 2-continued

| Specimen | Density (g/cm$^3$) | Hot-rolled material (TS and EL) | Cold-rolled material (TS, EL and Hole Expansion Ratio(HER)) | Remarks |
|---|---|---|---|---|
| 4 | 6.94 | 1,506 MPa and 18% | Breakage | Comparative Example |
| 5 | 6.91 | 1,329 MPa and 28% | Breakage | Comparative Example |
| 6 | 7.08 | 1,221 MPa and 28% | 1,221 MPa, 14% and 24% | Comparative Example |

As can be seen in Table 2 above, the results of measurement of density indicated that specimens 1 to 6 showed a density of 7.1 g/cm$^3$ or lower, which did differ depending on the content of aluminum.

In addition, as can be seen in Table 2 above, specimens 2 and 3 satisfying the steel composition according to the present invention showed a tensile strength of 1000 MPa or higher and an elongation of 20% or higher. This is believed to be because austenite and k-carbide in the cold-rolled steel sheet produced according to the present invention were refined.

However, in the case of specimens 1 and 4 to 6 that do not satisfy the steel composition according to the present invention, breakage occurred or the elongation was lower than 20%.

In addition, steel ingot specimens 7 to 13 having the alloy compositions shown in Table 3 below were prepared. In the case of steel specimens 7 to 13, the nitrogen content was fixed at 0.005 wt %.

Steel ingot specimens 7 to 13 were reheated at 1200° C. for 2 hours, hot-rolled at a finish-rolling temperature of 880° C., cooled to 350° C. at a rate of 20*C/sec, and then cooled in air to room temperature. Next, density measurement and tensile strength testing for the hot-rolled specimens were performed in the same manner as the case of steel specimens 1 to 6, and the results of the measurement are shown in Table 3 below.

TABLE 3

(unit: wt %)

| Specimen | Mn | Al | Cr | C | TiAl | Density (g/cm$^3$) | Hot-rolled material TS | Hot-rolled material EL | Remarks |
|---|---|---|---|---|---|---|---|---|---|
| 7 | 13.55 | 8.22 | 0.0028 | 1.16 | — | 6.93 | 1165 | 3.4 | Comparative Example |
| 8 | 13.22 | 7.98 | 2.29 | 0.79 | — | 6.98 | 941 | 13 | Comparative Example |
| 9 | 12.00 | 7.45 | 1.45 | 1.12 | 0.02 | 7.04 | 1092 | 31 | Comparative Example |
| 10 | 13.35 | 7.97 | 1.84 | 1.18 | 0.1 | 6.93 | 1285 | 29 | Example |
| 11 | 12.05 | 7.04 | 1.79 | 1.18 | 0.1 | 7.03 | 1298 | 31 | Example |
| 12 | 11.92 | 7.10 | 1.78 | 1.17 | 0.5 | 6.97 | 1286 | 28 | Example |
| 13 | 11.85 | 6.75 | 1.51 | 1.12 | 0.25 | 6.99 | 1367 | 32 | Example |

As can be seen in Table 3 above, specimens 10 to 13 satisfying the composition according to the present invention showed a tensile strength of 1200 MPa or higher and a product of tensile strength and elongation (TS×EL) of 35,000 MPa·% or higher. This is believed to be because austenite and k-carbide in the steel sheet produced according to the method of the present invention was refined and the dispersion of TiAl particles exhibited a dispersion strengthening effect. Particularly, in the case of specimen 13 having a TiAl content of 0.2-0.3 wt %, the product of tensile strength and elongation (TS×EL) was very high, suggesting that, in this TiAl content range, the dispersion strengthening effect of TiAl particles was the greatest while TiAl was not coarsened.

However, specimens 7 to 9 that do not satisfy the composition according to the present invention showed a tensile strength lower than 1200 MPa, and particularly, specimen 7 containing a very small amount of Cr showed a significantly low elongation. In addition, in the case of specimen 9 having a relatively low TiAl content of 0.02 wt %, the elongation was excellent, but the tensile strength was relatively low, and thus the value of tensile strength×elongation did not reach the target value of 35,000 MPa·%.

Although the preferred embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. A hot-rolled steel sheet comprising of, by weight, 10.0-15.0% manganese (Mn), 6.0-9.0% aluminum (Al), 0.5-2.0% chromium (Cr), 0.8-1.6% carbon (C), 0.001-0.01% nitrogen (N), and 0.1-0.5% TiAl particles, with the remainder being iron (Fe) and inevitable impurities, the steel sheet having a mixed structure comprising austenite and a k-carbide ((Fe,Mn)3AlC) having a mean grain size of 10-500 nm2 wherein the hot-roiled steel sheet having a tensile strength of 1200 MPa or higher and a product of tensile strength and elongation being 35,000 MPa-% or higher.

2. The hot-rolled steel sheet of claim 1, wherein the high-strength steel sheet has a density of 7.1 g/cm3 or lower.

3. The hot-rolled steel sheet of claim 1, further comprising, by weight, 11.0-13.0% manganese (Mn), 6.0-7.5% aluminum (Al), 1.0-2.0% chromium (Cr), and 1.0-1.2% carbon (C).

4. A method for producing a hot-rolled steel sheet, comprising: hot-rolling a steel slab comprising of, by weight, 10.0-15.0% manganese (Mn), 6.0-9.0% aluminum (Al), 0.5-2.0% chromium (Cr), 0.8-1.6% carbon (C), 0.001-0.01% nitrogen (N) and 0.1-0.5% TiAl particles, with the remainder being iron (Fe) and inevitable impurities, at a finish-rolling temperature equal to or higher than an Ar3 point of the steel slab to obtain hot-rolled steel sheet; and coiling the hot-rolled steel sheet at a temperature between 300° C. and 700° C., wherein the hot-rolled steel sheet having a mixed structure comprising austenite and a k-carbide ((Fe,Mn)3AlC) having a mean grain size of 10-200 nm2 and a tensile strength of 1200 MPa or higher and a product of tensile strength and elongation being 35,000 MPa-% or higher.

* * * * *